US009506301B2

(12) United States Patent
Routeau et al.

(10) Patent No.: US 9,506,301 B2
(45) Date of Patent: Nov. 29, 2016

(54) UNDERWATER CONNECTION ASSEMBLY AND CONNECTION METHOD

(71) Applicant: TECHNIP FRANCE, Courbevoie (FR)

(72) Inventors: Sylvain Routeau, Saint-Cloud (FR); Yasser Saleh, Paris (FR)

(73) Assignee: TECHNIP FRANCE (FR)

( * ) Notice: Subject to any disclaimer, the term of this patent is extended or adjusted under 35 U.S.C. 154(b) by 0 days.

(21) Appl. No.: 14/762,988

(22) PCT Filed: Jan. 24, 2014

(86) PCT No.: PCT/FR2014/050138

§ 371 (c)(1),
(2) Date: Jul. 23, 2015

(87) PCT Pub. No.: WO2014/117890

PCT Pub. Date: Jul. 31, 2014

(65) Prior Publication Data

US 2015/0354295 A1 Dec. 10, 2015

(30) Foreign Application Priority Data

Jan. 25, 2013 (FR) ..... 13 50661

(51) Int. Cl.

| | |
|---|---|
| ***E21B 19/00*** | (2006.01) |
| ***E21B 43/01*** | (2006.01) |
| ***E21B 19/16*** | (2006.01) |
| ***E21B 17/01*** | (2006.01) |
| ***E21B 17/04*** | (2006.01) |
| ***E21B 43/013*** | (2006.01) |

(52) U.S. Cl.

CPC ..... *E21B 19/002* (2013.01); *E21B 17/012* (2013.01); *E21B 17/015* (2013.01); *E21B 17/04* (2013.01); *E21B 19/16* (2013.01); *E21B 43/013* (2013.01); *E21B 43/0107* (2013.01)

(58) Field of Classification Search

CPC ..... E21B 43/013; E21B 17/015; E21B 43/0107; E21B 17/085; F16L 1/26; F16L 37/002; Y10T 403/1608; Y10T 403/1616

See application file for complete search history.

(56) References Cited

U.S. PATENT DOCUMENTS

| | | | | |
|---|---|---|---|---|
| 4,848,949 | A * | 7/1989 | Castel | E21B 43/013 166/341 |
| 4,878,694 | A * | 11/1989 | Castel | E21B 41/04 141/279 |
| 8,267,179 | B2 * | 9/2012 | Butcher | E21B 43/0107 166/341 |
| 2010/0314123 | A1 * | 12/2010 | Luppi | E21B 43/013 166/345 |

FOREIGN PATENT DOCUMENTS

| | | |
|---|---|---|
| GB | 2 468 653 | 9/2010 |
| WO | WO 2009/112687 A1 | 9/2009 |
| WO | WO 2012/076520 A2 | 6/2012 |

OTHER PUBLICATIONS

International Search Report dated Apr. 15, 2014 issued in corresponding International patent application No. PCT/FR2014/050138.
Written Opinion dated Apr. 15, 2014 issued in corresponding International patent application No. PCT/FR21014/050138.

* cited by examiner

*Primary Examiner* — James G Sayre
(74) *Attorney, Agent, or Firm* — Ostrolenk Faber LLP

(57) ABSTRACT

A connection assembly allowing a pipe (12) extending from the seabed (14) to be connected to a flexible pipe (26) leading to the sea surface (22). The assembly includes a turret (32) having an upper end (42) connected to a float (20) and a lower end (40) connected to the pipe (12). The turret (32) has a duct (50) extending towards the upper end (42) and having a free end (66) provided with an end fitting (68). The turret includes retaining members (70, 72, 74, 76) that keep the connector (30) between the turret and the end fitting, facing the end fitting (68). The connector (30) is in a fixed position in relation to the retaining members (70, 72, 74, 76) and a drive device (112) drives the end fitting (68) toward the connector (30).

12 Claims, 5 Drawing Sheets

Fig.7
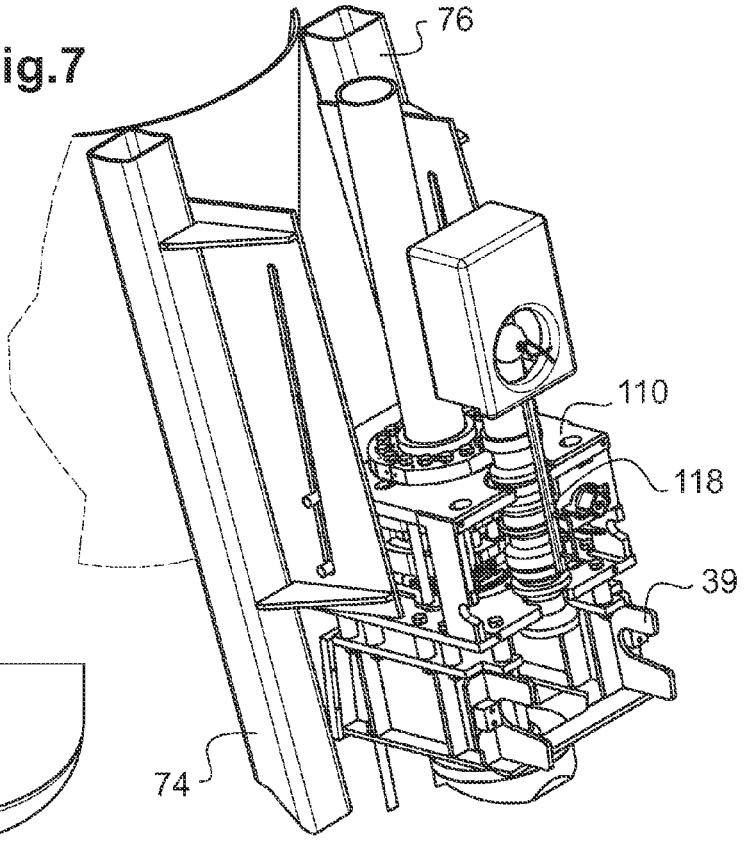
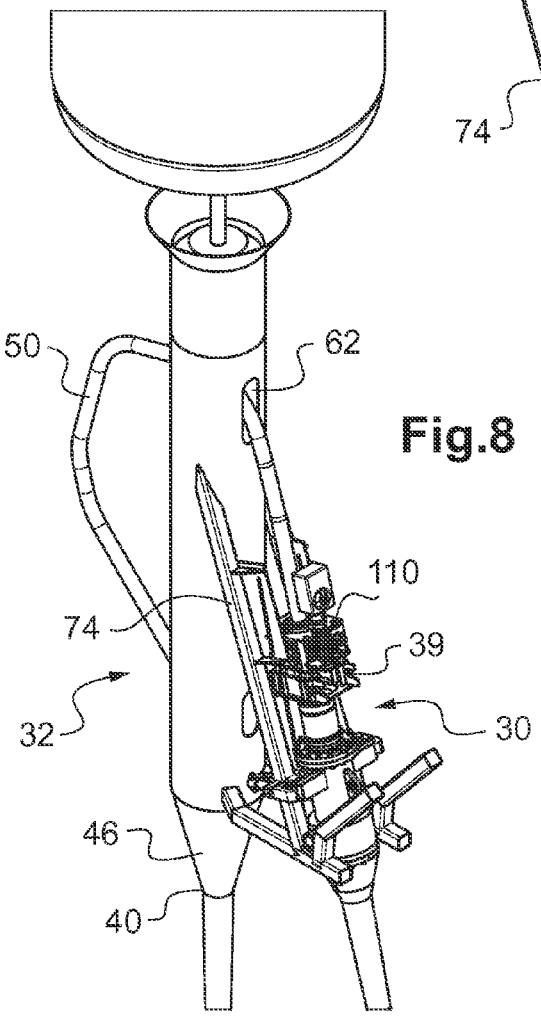
Fig.8

UNDERWATER CONNECTION ASSEMBLY AND CONNECTION METHOD

CROSS-REFERENCE TO RELATED APPLICATIONS

The present application is a 35 U.S.C. §§371 national phase conversion of PCT/FR2014/050138, filed Jan. 24, 2014, which claims priority of French Application No. 1350661, filed Jan. 25, 2013, the contents of which are incorporated by reference herein. The PCT International Application was published in the French language.

The present invention relates to the field of underwater installations enabling hydrocarbons to be conveyed between a seabed and a surface.

One field of application envisaged is notably that of petroleum exploitation at great depths.

TECHNICAL BACKGROUND

Such well-known underwater installations include a riser pipe that extends from the seabed as far as an intermediate area overlying the seabed and situated below the surface and a flexible pipe connected to extend the riser pipe and that extends catenary fashion from the intermediate area to the surface. The riser pipe is kept substantially vertical by means of a float submerged in the intermediate area. This type of installation makes it possible to raise hydrocarbons from the seabed to the surface without being constrained by disturbances of the surface linked to swell, currents or winds.

The document WO2009/112 687 describes an underwater installation of this type. The underwater installation usually includes a frame or a turret enabling the end of the riser pipe and the float to be connected together, and the frame is equipped with a swan-neck pipe that extends the riser. The pipe has a free end provided with an end fitting. In a first installation phase, the frame and the float hold the riser pipe in vertical equilibrium. In a second installation phase the flexible pipe terminated by a connector is connected to the end fitting, from the surface, so as to establish the connection between the riser pipe and the flexible pipe. To this end, the connector is specifically equipped with a flange and is installed at the end of the flexible pipe. It approaches the frame as the flexible pipe is paid out from the surface. As for the frame, it includes retaining members and the flange is then engaged in the retaining members. More of the flexible pipe is paid out and the connector then tilts around the retaining means so that it faces the end fitting on the pipe. The connector is then driven toward the end fitting to connect them together.

Difficulties arise in connecting the connector to the end fitting at greater depths of water. In fact, the riser pipes are longer and consequently heavier. The same goes for the flexible pipes and the forces to be exerted on the connector are consequently higher. Now the latter connectors are fragile and costly. Moreover, during the phase of moving the connector and the frame closer to each other, and given the masses involved, the slightest impacts can have an impact on the integrity of the connector.

SUMMARY OF THE INVENTION

Also, a problem that arises and that the present invention aims to solve is to provide an underwater connection assembly that precisely makes it possible to protect the connector, notably during connection.

To this end, in accordance with a first object, the present invention proposes an underwater connection assembly intended to be suspended from a float installed between a seabed and a surface of the sea to be able to connect a riser pipe extending from said seabed toward said surface to a flexible pipe extending to said surface. The assembly comprises a turret having an upper end adapted to be connected to said float and a lower end adapted to be connected to said riser pipe. The turret comprises a deformable swan-neck pipe fastened to said lower end and extending freely toward said upper end. The pipe has a free end fitted with an end fitting, while the flexible pipe includes a connector. The turret further comprises retaining members so as to be able to retain said connector facing said end fitting. The assembly further comprises a driving device for driving said end fitting and said connector toward each other so as to connect them to each other. In accordance with the invention, said connector is held in a fixed position relative to said retaining members and said driving device causes said end fitting to be driven towards said connector whereas said pipe is deformed.

One feature of the invention therefore resides in the use of a deformable pipe passing through the turret so as to be able to drive the end fitting toward the connector as soon as the latter has been pressed onto the retaining members. Then the deformable pipe is deformed when the end fitting is driven in movement. As a result, the movements of the connector are extremely limited and likewise the possibilities of it being damaged are limited. Moreover, the forces necessary to move the two flanges toward each other remain low compared to the weight of the flexible pipe.

Moreover, and in accordance with one particularly advantageous embodiment of the invention, said retaining members are mounted in the vicinity of said lower end, which makes it possible to press the connector substantially into its connection position, in which it is oriented toward the surface, whereas the flexible pipe extends toward the seabed. There is consequently no requirement to cause it to tilt around the retaining members, which limits the possibilities of movement of the connector relative to the frame and consequently the possibilities of impact and damage.

Moreover, said turret is advantageously equipped with guide ramps oriented from said upper end toward said retaining members so as to be able to guide the end fitting of the deformable pipe in translation when the latter is driven toward the connector. These ramps are installed laterally on each side of the end fitting, for example. Also, the end fitting preferably includes guide fingers adapted to cooperate with said guide ramps. Two guide fingers are mounted opposite each other on the end fitting, for example, so as to be able to cooperate with the respective lateral ramps.

In accordance with one particular embodiment of the invention, said retaining members include two V-shaped arms extending parallel to each other from said turret to form two spaced bearing surfaces. Also, the connector is equipped with two diametrically opposite journals, which come to bear in the respective bearing surfaces, when it is engaged between the two V-shaped arms. The connector then extends vertically, oriented toward the surface, whereas the flexible pipe hangs down. The method of installation is explained in more detail hereinafter.

Moreover, said driving device preferably comprises a retractable member, for example a hydraulic cylinder, adapted to connect said end fitting and said connector. Also, said retaining members include members for locking said connector. As a result, the connector is held in a fixed position relative to the turret and when the retractable member is retracted it is the end fitting of the deformable pipe that is driven toward the connector, whereas the latter remains immobile relative to the turret.

Moreover, said deformable pipe advantageously includes a first part extending outside said turret opposite said retaining members and a second part passing completely through said turret and ending at said free end. The pipe is made from a rigid material, for example steel, and is sufficiently long compared to its diameter to be able to deform elastically. The deformable pipe therefore substantially forms a loop and when the end fitting is driven in translation toward the connector the loop formed by the pipe tightens. Moreover, said deformable pipe further includes a fixing part extending axially inside said turret and connected to said first part. The pipe is therefore fastened to the lower end of the turret and is connected to the riser pipe, which it extends.

Said turret advantageously comprises a hollow cylindrical part having on the one hand a lower opening and a first upper opening spaced from each other along the same generatrix and on the other hand a second upper opening diametrically opposite said first upper opening. The openings therefore allow the free passage of the deformable pipe, said first part through the first lower opening and said second part through the two diametrically opposite upper openings. The openings are oblong and extend in the axial direction of the turret so as to allow the movement of the deformable pipe.

Said retaining members are preferably mounted on said hollow cylindrical part in a position diametrically opposite said lower opening.

In accordance with another object, the present invention proposes an underwater connection method for connecting, between a seabed and a surface, a riser pipe extending from said seabed toward said surface to a flexible pipe extending to said surface, said method being of the type comprising the following steps: procuring a flexible pipe including a connector; procuring a turret including an upper end and a lower end, said turret comprising on the one hand retaining members and on the other hand a deformable swan-neck pipe fastened to said lower end and extending freely toward said upper end, said pipe including a free end provided with an end fitting and facing said retaining members; installing a float between said surface and said seabed and connecting on the one hand said upper end of said turret to said float and on the other hand said riser pipe to said lower end of said turret; causing said connector to press on said retaining means to retain said connector facing said end fitting; and driving said end fitting and said connector toward each other so as to connect them to each other. According to the invention, said connector is retained in a fixed position relative to said retaining members and said end fitting is driven toward said connector, whereas said pipe is deformed. The connection method in accordance with the invention is explained in more detail hereinafter.

Other features and advantages of the invention will emerge on reading the description of one particular embodiment of the invention given hereinafter by way of nonlimiting illustration and with reference to the appended drawings, in which:

BRIEF DESCRIPTION OF THE DRAWINGS

FIG. 7 is a diagrammatic view of a detail of the connection assembly shown in FIG. 6, in a second state;

FIG. 8 is a diagrammatic general view of the connection assembly in said second state.

DESCRIPTION OF EMBODIMENTS

Figure 1:
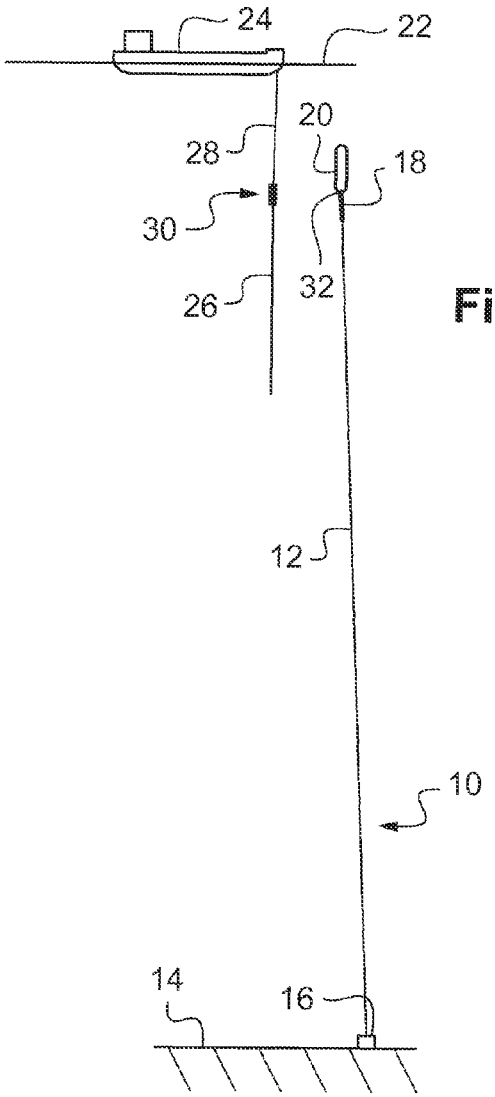
FIG. 1 is a diagrammatic view showing an underwater connection method according to the invention.

FIG. 1 shows diagrammatically a tower 10 including a rigid riser pipe 12 fixed to a seabed 14 by means of an anchor system 16. Moreover, the rigid pipe 12 includes an upper part 18, suspended from a float 20, or a buoy, in which is trapped a sufficient quantity of air to maintain the rigid pipe in a vertical position. The float 20 is situated in an area between the seabed 14 and a surface 22, and to be more precise, toward the surface 22. This area is nevertheless chosen at a distance from the surface 22 so as to be less dependent on surface movements.

FIG. 1 also shows a laying ship 24 sailing on the surface 22 in line with the tower 10. A flexible pipe 26 is suspended from the laying ship 24 by means of a cable 28. The flexible pipe 26 includes a connector 30 to which the cable 28 is connected. The flexible pipe 26 is therefore supported by the laying ship 24 in the vicinity of the upper part 18 of the rigid pipe 12 in order to be connected thereto as explained hereinafter. To this end, the upper part 18 of the rigid pipe 12 includes a turret 32 described with reference to FIG. 2.

Figure 2:
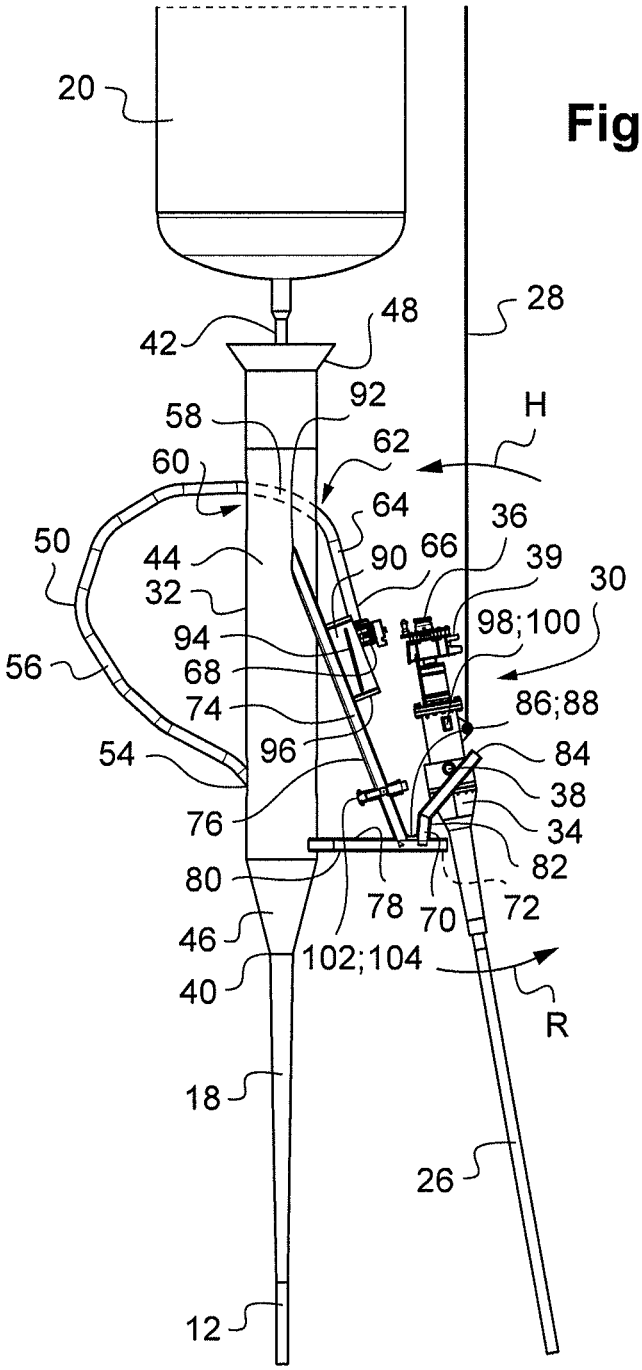
FIG. 2 is a diagrammatic side view of the underwater connection assembly according to the invention in a first step of its use.

FIG. 2 shows partially the float 20 and the rigid pipe 12 connected together by way of the turret 32. Also shown is the flexible pipe 26 suspended from the cable 28 by means of the connector 30. The latter includes a sleeve 34 on the upstream side of a connecting free end 36. The sleeve 34 includes two diametrically opposite and projecting journals 38 while the connector 30 includes an attachment member 39 forming a shoulder and that extends around the connecting free end 36.

The turret 32 has a lower end 40 opposite an upper end 42. The lower end 40 is connected to the rigid pipe 12 while the upper end 42 is attached to the float 20. The turret 32 includes a hollow longitudinal cylindrical part 44 and a conical part 46 at the lower end 40 and a flange 48 at the upper end 42. Moreover, the turret 32 includes a deformable swan-neck pipe 50 extending from the lower end 40 of the turret 32. It will be noted that the deformable pipe 50 is made from a rigid metal, for example steel. In accordance with another embodiment, a deformable pipe is used made from a conventional flexible pipe of bonded or other construction.

Figure 3:
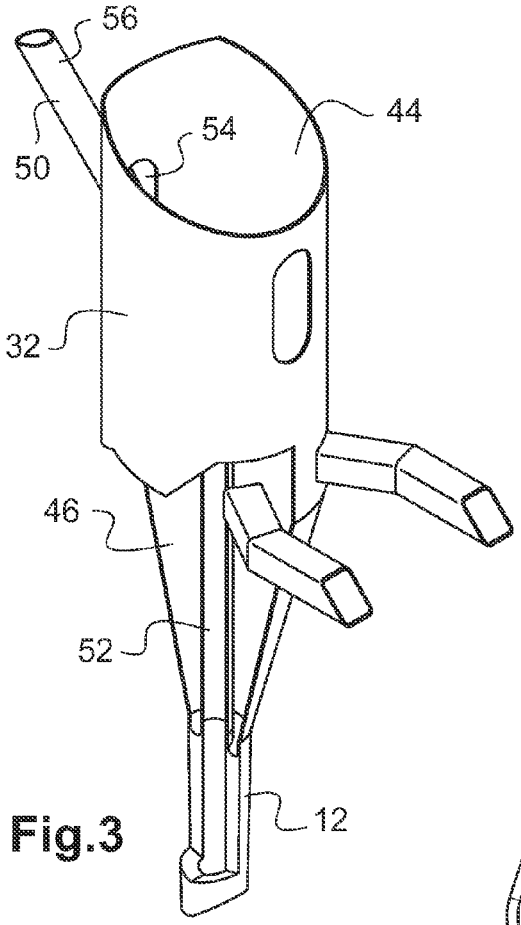
FIG. 3 is a diagrammatic cutaway view of a detail of the underwater connection assembly shown in FIG. 2.

FIG. 3 is also referred to in order to describe the arrangement of the deformable pipe 50 through the turret 32. FIG. 3 shows part of the turret 32 and in its conical part 46 an axial portion 52 of a deformable pipe 50. Also shown is the rigid pipe 12 and the turret 32 is connected to its end at the level of the tip of the conical part 46. The axial portion 52 of the deformable pipe 50 is therefore in line with the rigid pipe 12. The cylindrical part 44 includes a lower oblong opening 54 that extends along a generatrix and through which a first radial portion 56 of the deformable pipe 50 extends. The first radial portion 56 extends from the axial portion 52, which is curved at the level of the lower oblong opening 54 so as to extend out of the turret 32.

As shown in FIG. 2, the first radial portion 56 is curved with an opposite curvature toward the upper end 42 and in an axial plane of the turret 32. The deformable pipe 50 then has a transverse portion 58 passing completely through the cylindrical part 44 via two opposite upper oblong openings 60, 62. One of the upper oblong openings 60 extends along the same generatrix as the lower oblong opening 54.

The deformable pipe 50 includes a second radial portion 64 curved toward the lower end 40 and extending from the transverse portion 58 in the direction away from the first radial portion 56. The second radial portion 64 has a free end 66 provided with an end fitting 68.

Moreover, opposite the lower oblong opening 54, near the lower end 40 of the turret 32, are two parallel V-shaped arms 70, 72. The two V-shaped arms 70, 72 are retained by two respective parallel uprights 74, 76 that extend toward the upper end 42 at the level of the other upper oblong opening 62. The two V-shaped arms 70, 72 have a respective first part 78, 80 that extends in a direction substantially perpendicular to the turret 32 and an inclined second part 82, 84 that extends freely away from the lower end 40. The two V-shaped arms 70, 72 therefore have a respective joint 86, 88 at the level of which the uprights 74, 76 are connected. As a result, the uprights 74, 76 and the V-shaped arms 70, 72 in two parts respectively form at the level of the joints 86, 88 U-shaped spaces forming spaced bearing surfaces.

In accordance with another embodiment that is not shown, the turret is constituted of a longitudinal frame including two parallel uprights and an upper crossmember opposite a lower crossmember. Moreover, the frame includes pairs of intermediate crossmembers situated between the opposite upper and lower crossmembers. Also, the two V-shaped arms 70, 72 and the corresponding uprights 74, 76 are respectively installed on two superposed intermediate crossmembers of the same pair. The first parts 78, 80 of the two V-shaped arms 70, 72 are advantageously respectively connected to the two uprights 74, 76 to form two opposite flanges. These two flanges are then respectively fastened to two superposed intermediate crossmembers. Such an arrangement makes it possible to have the bearing surfaces close to the axis of the rigid riser pipe 12. Moreover, this makes it possible to reduce the overall volume of the turret 32 and the retaining members (70, 72, 74, 76).

Moreover, the first parts 78, 80 of the two V-shaped arms 70, 72 are mounted and articulated at the level of the joints 86, 88 so that they can be retracted, notably during transportation and installation.

Also, thanks to the pairs of intermediate crossmembers, in accordance with another embodiment, other sets of retaining members of the aforementioned type may be installed so as to be able to connect other pipes in an analogous manner.

As FIG. 2 shows, the connector 30 is engaged between the second inclined parts 82, 84 of the two V-shaped arms 70, 72 by paying out the cable 28. Also, the two journals 38 installed on the sleeve 34 of the connector 30 respectively come to bear against the inclined second parts 82, 84. As the lowering of the connector 30 continues, the second inclined parts 82, 84 then form a ramp and guide the journals 38 toward the joints 86, 88 forming bearing surfaces. The connector 30 is then suspended from the two V-shaped arms 70, 72.

It will moreover be noted that the uprights 74, 76 are respectively equipped with two parallel plates 90, 92 between which lie the free end 66 and the end fitting 68. These plates 90, 92 include a respective guide groove 94 extending substantially from said other upper oblong opening 62 toward the V-shaped arms 70, 72 and form a lower abutment 96 also oriented toward the V-shaped arms 70, 72. The functions of the guide grooves 84 and the lower abutment 96 are explained hereinafter.

Moreover, it will be noted that the connector includes between the journals 38 and the connecting free end 36 two opposite lugs 98, 100 while the uprights 74, 76 are equipped with clamping devices 102, 104.

Accordingly, after the connector 30 has been suspended from the two V-shaped arms 70, 72, the journals 38 respectively bear in the bearing surfaces, the cable 28 is then released, whereas the flexible pipe 26 hangs down. The other end of the flexible pipe 26, not shown, is then taken up by another cable to be raised toward the laying ship. The connector 30 is then driven to pivot anticlockwise as the flexible pipe 26 is raised. The attachment member 39 is then pressed to the rear of the lower abutments 96 of the plates 90, 92 while the connecting free end 36 comes to face the end fitting 68.

Figure 4:
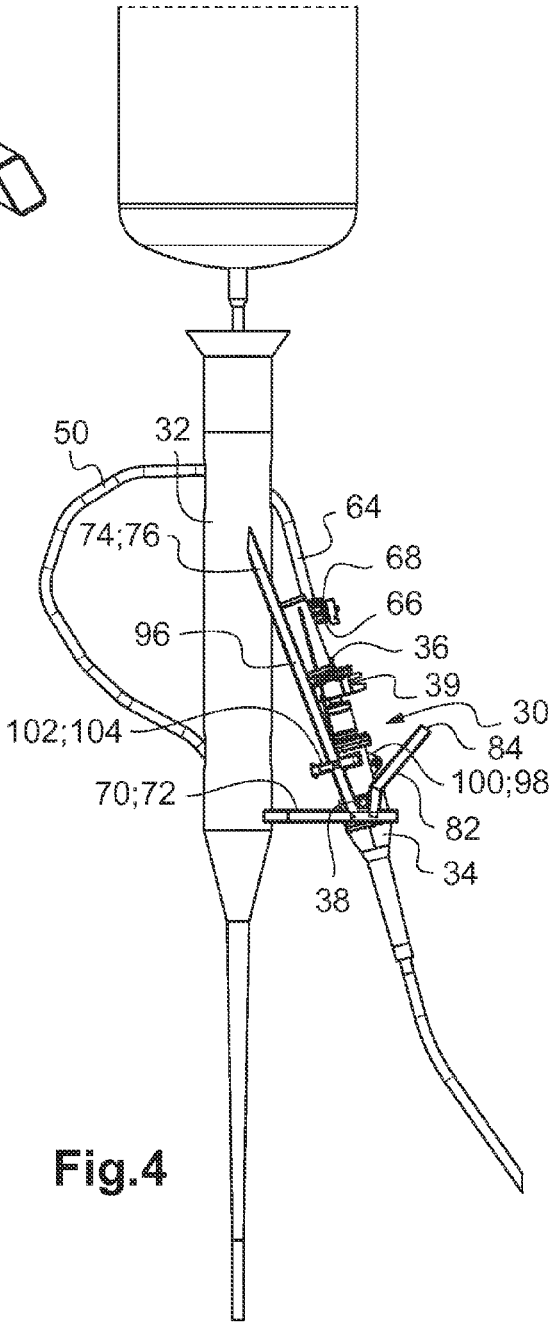
FIG. 4 is a diagrammatic side view of the connection assembly shown in FIG. 2 in a first state.

The situation is therefore that of FIG. 4, with the connector 30 pivoted in this way and its attachment member 39 to the rear of the lower abutments 96. Moreover, the two lugs 98, 100 are engaged in the clamping tools 102, 104 so as to lock the connector 30 against the uprights 74, 76 and bearing on the V-shaped arms 70, 72. Its connecting free end 36 therefore then comes to face the end fitting 68 at the free end 66 of the deformable pipe 50. As a result, the connector 30 is fastened to the turret 32. It will be noted that until this point movements of the connector 30 relative to the turret 32 and its elements have been accompanied and limited. The risks of damage by impact or by contact have therefore been reduced.

Figure 5:
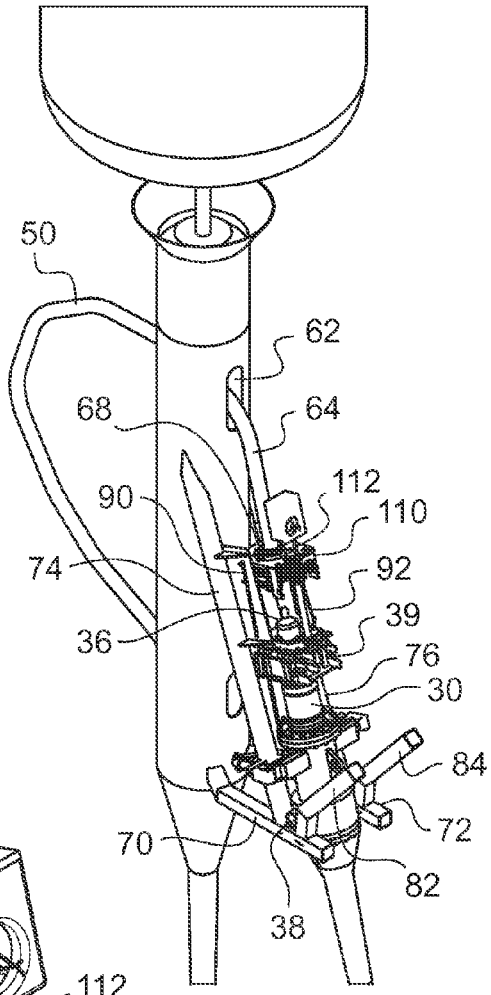
FIG. 5 is a diagrammatic three-quarter front view of the connection assembly shown in FIG. 4.

FIG. 5 is a three-quarter view of the connector 30 installed in this way. Moreover, there is seen in this figure, around the end fitting 68, a guide support block 110 and a hydraulic cylinder 112 connecting the attachment member 39 and the guide support block 110. The hydraulic cylinder 112 has been installed by an underwater robot that is not shown.

Figure 6:
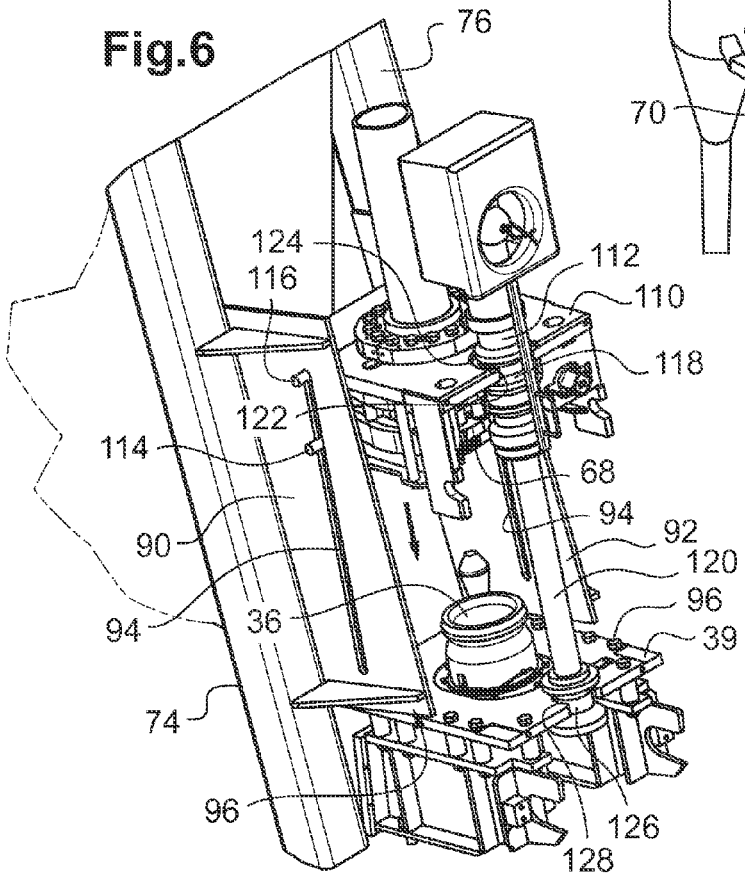
FIG. 6 is a diagrammatic view of a detail of the connection assembly shown in FIG. 5.

Refer now to FIG. 6 showing in detail the guide support block 110 and the attachment member 39. This figure shows the two opposite plates 90, 92 respectively equipped with their guide groove 94. The guide support block 110 is engaged between the two opposite plates 90, 92 and is equipped on each side with two guide fingers 114, 116 engaged in the guide grooves 94. The guide fingers 114, 116 are seen on only one side, while the other two are concealed and lie to the rear of the figure.

Moreover, the attachment member 39 is to the rear of the lower abutments 96 formed by the opposite plates 90, 92.

Moreover, the hydraulic cylinder 112, which is seen more clearly in FIG. 6, includes a body 118 and a rod 120 mounted inside the body 118. The body 118 includes a body groove 122 while the guide support block 110 includes a block notch 124 adapted to receive the body 118 of the cylinder 112. The rod 120 includes at its end a rod groove 126 while the attachment member 39 includes an attachment notch 128 adapted to receive the end of the rod 120.

Moreover, the connecting free end 36 faces the end fitting 68 substantially coaxially, which end fitting 68 has an inside diameter substantially greater than the outside diameter of the connecting free end 36. Moreover, the end fitting 68 includes sealing lips, not shown, and a spring-loaded automatic locking mechanism, for example, or a manually controlled mechanism, for locking thereto the connecting free end 36 when they are driven one into the other. The connection is therefore sealed.

In this situation, and by means of an underwater robot that is not shown, the hydraulic cylinder 112 is activated so as to retract the rod 120 into the body 118. Also, the retraction of the rod 120 of the cylinder into the body 118 causes the guide support block 110 to be driven toward the attachment member 39 since the latter is immobilized against movement in translation by the lower abutments 96 and the guide support block 110 is guided in translation by means of the guide fingers 114, 116 in the grooves 94.

FIG. 7 shows the guide support block 110 at the end of its stroke against the attachment member 39 while the rod 120 of the cylinder is entirely retracted inside the body 118. Thanks to the aforementioned automatic locking mechanism, the connecting free end 36 is locked inside the end fitting 68 and they are therefore fastened to each other in a sealed manner.

FIG. 8 shows to a larger scale the turret 32 and the guide support 110 pressed against the attachment member 39. It will be noted that the deformable pipe 50 has then been deformed during the movement of the guide support 110 toward the attachment member 39. In fact, the deformable pipe 50 has been stretched freely through the two opposite upper oblong openings 60, 62 and to a lesser degree through the lower oblong opening 54.

As a result, the connecting free end 36 and the end fitting 68 are locked exclusively by the movement of the guide support 110 and the deformable pipe 50 relative to the turret 32. Thanks to this, the connector 30 has not been subjected to any impact during connection that might have damaged it.

Figure 9:
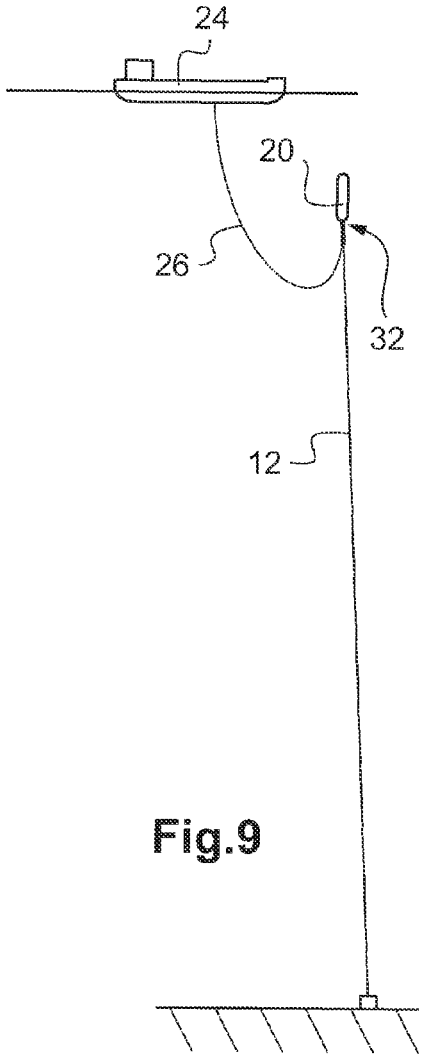
FIG. 9 is a diagrammatic view showing the elements represented in FIG. 1 in a final step of its use.

FIG. 9 therefore shows the rigid pipe 12 and the flexible pipe 26 connected together at the level of the float 20 by means of the turret 32; the other end of the flexible pipe 26 having been entirely raised onto the laying ship 24.

The invention claimed is:

1. An underwater connection assembly configured to be suspended comprising:

a float installed between a seabed and a surface of the sea for connecting a riser pipe extending from said seabed and toward said surface to a flexible pipe extending from said float to said surface, and a turret which, when said connection assembly is in the sea, has an upper end configured to be connected to said float and a lower end configured to be connected to said riser pipe, said turret comprising a deformable swan-neck pipe fastened to said lower end of said turret and extending freely toward said upper end of said turret, said swan-neck pipe having a free end fitted with an end fitting, said flexible pipe including a connector;

wherein said turret further comprises retaining members configured for retaining said connector facing said end fitting; and a driving device is configured and operable to drive said end fitting toward said connector to connect said end fitting to said connector, thereby deforming said deformable swan-neck pipe during the driving of said end fitting toward said connector, said connector being prevented from moving in translation while said end fitting is driven toward said connector.

2. The underwater connection assembly as claimed in claim 1, wherein said retaining members are mounted in a vicinity of said lower end of said turret.

3. The underwater connection assembly as claimed in claim 2, wherein said turret has guide ramps oriented from said upper end of said turret toward said retaining members.

4. The underwater connection assembly as claimed in claim 3, wherein said end fitting of said deformable swan-neck pipe has guide fingers configured to cooperate with said guide ramps.

5. The underwater connection assembly according to claim 1, wherein said retaining members includes two V-shaped arms extending parallel to each other from said turret, said two V-shaped arms forming two spaced bearing surfaces.

6. The underwater connection assembly according to claim 1, wherein said driving device comprises a retractable member configured to connect said end fitting of said deformable swan-neck pipe and said connector.

7. The underwater connection assembly according to claim 1, wherein said retaining members include members for locking said connector.

8. The underwater connection assembly according to claim 1, wherein said deformable swan-neck pipe includes a first part extending outside said turret and opposite said retaining members and a second part of said deformable swan-neck pipe passes completely through said turret and ends at said free end of said deformable swan-neck pipe.

9. The underwater connection assembly as claimed in claim 8, wherein said deformable swan-neck pipe further includes a fixing part extending axially inside said turret and connected to said first part of said deformable swan-neck pipe.

10. The underwater connection assembly according to claim 1, wherein said turret comprises a hollow cylindrical part including a lower opening and a first upper opening in said turret spaced from each other along a generatrix of the hollow cylindrical part and a second upper opening in said turret diametrically opposite said first upper opening.

11. The underwater connection assembly as claimed in claim 9, wherein said retaining members are mounted on said hollow cylindrical part in a position diametrically opposite said lower opening.

12. An underwater connection method for connecting, between a seabed and a sea surface, a riser pipe extending from said seabed toward said surface to a flexible pipe extending to said surface, said method comprising the following steps:

providing a flexible pipe including a connector;

providing a turret including an upper end and a lower end, retaining members, and a deformable swan-neck pipe fastened to said lower end and extending freely toward said upper end, said deformable swan-neck pipe including a free end provided with an end fitting and facing said retaining members;

installing a float between said surface and said seabed, connecting said upper end of said turret to said float, and connecting said riser pipe to said lower end of said turret; and causing said connector to press on said retaining members for retaining said connector facing said end fitting; and driving said end fitting at said free end toward said connector on said flexible pipe to connect said end fitting to said connector, thereby deforming said deformable swan-neck pipe during the driving of said end fitting toward said connector, said connector being prevented from moving in translation while said end fitting is driven toward said connector.

* * * * *